US008985150B2

(12) United States Patent
Fripp et al.

(10) Patent No.: US 8,985,150 B2
(45) Date of Patent: Mar. 24, 2015

(54) DEVICE FOR DIRECTING THE FLOW OF A FLUID USING A CENTRIFUGAL SWITCH

(75) Inventors: Michael L. Fripp, Carrollton, TX (US); Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 636 days.

(21) Appl. No.: 13/100,006

(22) Filed: May 3, 2011

(65) Prior Publication Data

US 2012/0279593 A1 Nov. 8, 2012

(51) Int. Cl.
*F15C 1/16* (2006.01)
*F15D 1/00* (2006.01)

(52) U.S. Cl.
CPC ..... *F15D 1/0015* (2013.01)
USPC ..... 137/808; 137/809; 137/810; 137/811; 137/812; 137/599.01; 137/834

(58) Field of Classification Search
CPC ..... F15C 1/16; F15C 1/008; F15D 1/0015; G05D 7/0186
USPC ..... 137/806, 808–813, 599.01, 834
See application file for complete search history.

(56) References Cited

U.S. PATENT DOCUMENTS 3,467,121 A * 9/1969 Bowles ..... 137/7
3,566,900 A 3/1971 Black (Continued)

FOREIGN PATENT DOCUMENTS

WO WO 2010053378 A2 5/2010
WO WO 2010087719 A1 8/2010

(Continued)

OTHER PUBLICATIONS

Angrist, Fluid Control Devices, Scientific American, Dec. 1964, pp. 80-88, USA.

(Continued)

*Primary Examiner* — Craig Schneider
*Assistant Examiner* — Minh Le
(74) *Attorney, Agent, or Firm* — Scott Richardson; Sherri Higgins Law; Sheri Higgins

(57) ABSTRACT

According to an embodiment, a device for directing the flow of a fluid comprises: a fluid chamber; a first outlet; a second outlet; a first outlet fluid passageway, wherein the first outlet fluid passageway is operatively connected to the first outlet; and a second outlet fluid passageway, wherein the second outlet fluid passageway is operatively connected to the second outlet; wherein the fluid rotationally flows about the inside of the chamber, and wherein the fluid flowing through the first outlet fluid passageway conjoins with the fluid flowing through the second outlet fluid passageway at a point downstream of the first and second outlet. According to another embodiment, a device for directing the flow of a fluid comprises: a sensor; a first outlet connected to the sensor; a second outlet connected to the sensor; a first outlet fluid passageway; and a second outlet fluid passageway; wherein as the total number of phases of the fluid increases, the sensor directs at least a first phase of the fluid into the first outlet fluid passageway and directs at least a second phase of the fluid into the second outlet fluid passageway, and wherein the fluid flowing through the first outlet fluid passageway conjoins with the fluid flowing through the second outlet fluid passageway at a point downstream of the first and second outlet.

16 Claims, 7 Drawing Sheets

(56) References Cited

U.S. PATENT DOCUMENTS

| | | | | |
|---|---|---|---|---|
| 3,586,104 | A | 6/1971 | Hyde | |
| 3,620,238 | A * | 11/1971 | Kawabata | 137/810 |
| 3,712,321 | A | 1/1973 | Bauer | |
| 4,091,716 | A * | 5/1978 | Ryan | 91/49 |
| 4,276,943 | A | 7/1981 | Holmes | |
| 4,323,991 | A | 4/1982 | Holmes et al. | |
| 4,343,707 | A * | 8/1982 | Lucas | 210/695 |
| 4,418,721 | A | 12/1983 | Holmes | |
| 4,557,295 | A | 12/1985 | Holmes | |
| 4,817,863 | A * | 4/1989 | Bragg et al. | 236/49.4 |
| 4,857,197 | A | 8/1989 | Young et al. | |
| 4,895,582 | A | 1/1990 | Bielefeldt | |
| 5,076,327 | A | 12/1991 | Mettner | |
| 5,578,209 | A * | 11/1996 | Weiss | 210/512.1 |
| 6,497,252 | B1 | 12/2002 | Kohler et al. | |
| 6,569,323 | B1 * | 5/2003 | Pribytkov | 210/181 |
| 7,828,067 | B2 | 11/2010 | Scott et al. | |
| 8,187,553 | B2 * | 5/2012 | Lee | 422/211 |
| 2007/0028977 | A1 | 2/2007 | Goulet | |
| 2009/0120647 | A1 | 5/2009 | Turick et al. | |
| 2011/0042091 | A1 | 2/2011 | Dykstra et al. | |
| 2011/0042092 | A1 | 2/2011 | Fripp et al. | |
| 2011/0198097 | A1 | 8/2011 | Moen | |

FOREIGN PATENT DOCUMENTS

| | | | |
|---|---|---|---|
| WO | WO 2011041674 | A2 | 4/2011 |
| WO | WO 2011095512 | A2 | 8/2011 |
| WO | WO 2011115494 | A1 | 9/2011 |

OTHER PUBLICATIONS

Wright et al., The Development and Application of HT/HP Fiber Optic Connectors for Use on Subsea Intelligent Wells, OTC 15323, May 2003, pp. 1-8, For Presentation in 2003 OTC Conference in Houston, Texas, USA.

Freyer et al., An Oil Selective Inflow Control System, SPE 78272, Oct. 2002, pp. 1-8, For Presentation in 2002 SPE Conference in Aberdeen, Scotland, U.K.

* cited by examiner

DEVICE FOR DIRECTING THE FLOW OF A FLUID USING A CENTRIFUGAL SWITCH

TECHNICAL FIELD

A device for directing the flow of a fluid is provided. In certain embodiments, the device directs the fluid based on the density or viscosity of the fluid. According to an embodiment, the device is used in a flow regulator. According to another embodiment, the flow regulator is used in a subterranean formation.

SUMMARY

According to an embodiment, a device for directing the flow of a fluid comprises: a fluid chamber; a first outlet; a second outlet; a first outlet fluid passageway, wherein the first outlet fluid passageway is operatively connected to the first outlet; and a second outlet fluid passageway, wherein the second outlet fluid passageway is operatively connected to the second outlet; wherein the fluid rotationally flows about the inside of the chamber, and wherein the fluid flowing through the first outlet fluid passageway conjoins with the fluid flowing through the second outlet fluid passageway at a point downstream of the first and second outlet.

According to another embodiment, depending on at least one of the properties of the fluid, the fluid rotationally flows closer to the outside of the chamber, closer to the center of the chamber, or closer to the outside and closer to the center of the chamber. The at least one of the properties can be density or viscosity.

According to another embodiment, a device for directing the flow of a fluid comprises: a sensor; a first outlet connected to the sensor; a second outlet connected to the sensor; a first outlet fluid passageway, wherein the first outlet fluid passageway is operatively connected to the first outlet; and a second outlet fluid passageway, wherein the second outlet fluid passageway is operatively connected to the second outlet; wherein as the total number of phases of the fluid increases, the sensor directs at least a first phase of the fluid into the first outlet fluid passageway and directs at least a second phase of the fluid into the second outlet fluid passageway, and wherein the fluid flowing through the first outlet fluid passageway conjoins with the fluid flowing through the second outlet fluid passageway at a point downstream of the first and second outlet.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
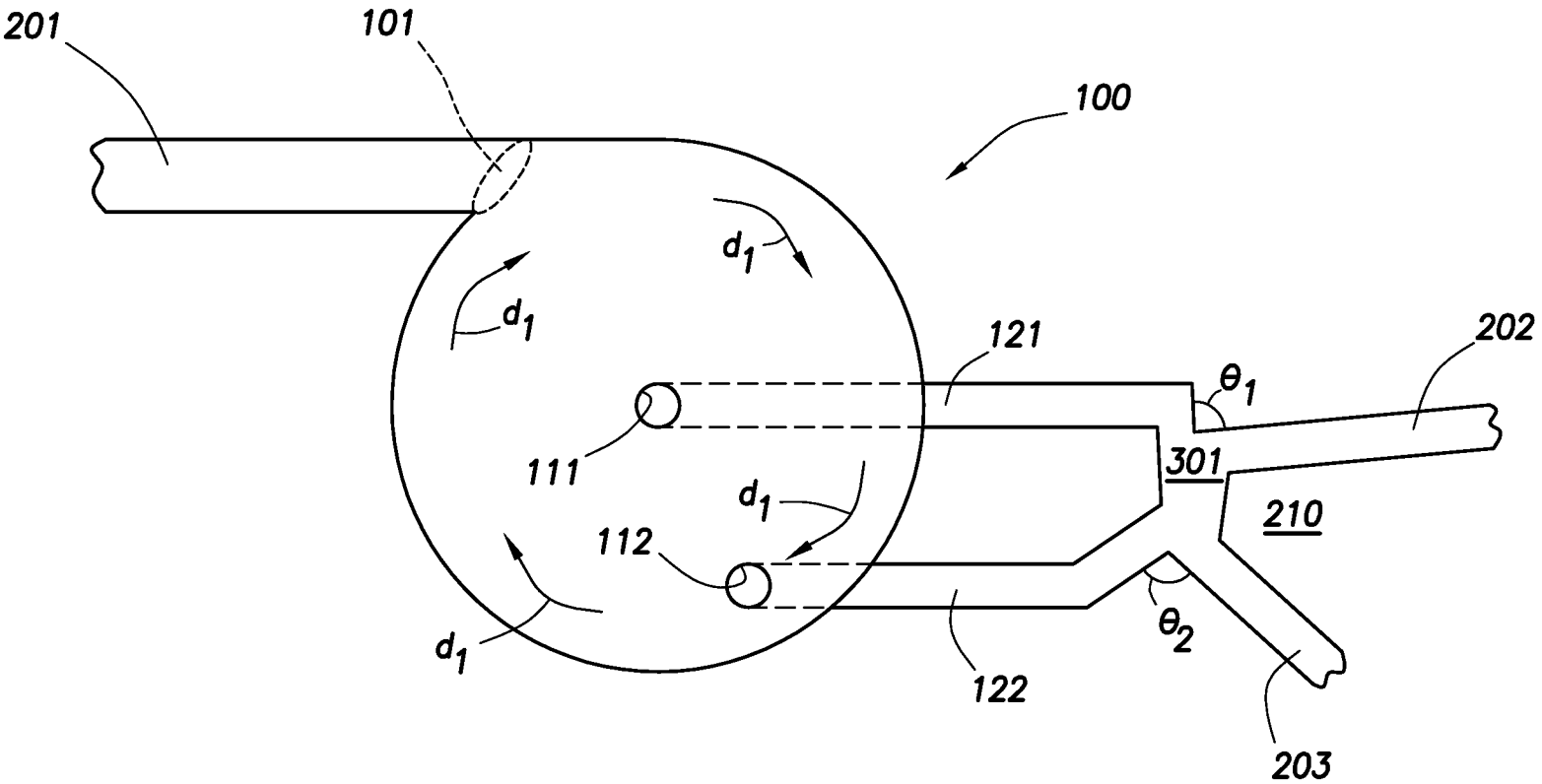
FIG. 1 is a diagram of a device for directing the flow of a fluid.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more passageways, devices, etc., as the case may be, and does not indicate any sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase. One of the physical properties of a fluid is its density. Density is the mass per unit of volume of a substance, commonly expressed in units of pounds per gallon (ppg) or kilograms per liter (kg/L). Fluids can have different densities. For example, the density of deionized water is approximately 1 kg/L; whereas the density of crude oil is approximately 865 kg/L. A homogenous fluid will have only one density; however, a heterogeneous fluid will have at least two different densities. For example, one of the phases in a heterogeneous fluid will have a specific density and each of the other phases in the heterogeneous fluid will have a different density. Another physical property of a fluid is its viscosity. Viscosity is a measure of the resistance of a fluid to flow, defined as the ratio of shear stress to shear rate. Viscosity can be expressed in units of (force*time)/area. For example, viscosity can be expressed in units of dyne*s/cm$^2$ (commonly referred to as Poise (P)), or expressed in units of Pascals/second (Pa/s). However, because a material that has a viscosity of 1 P is a relatively viscous material, viscosity is more commonly expressed in units of centipoise (cP), which is $1/100$ P.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, water, or injection well. A well used to produce oil or gas is generally referred to as a production well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. As used herein, "into a well" means and includes into any portion of the well, including into the wellbore or into a near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore which can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

A wellbore can extend several hundreds of feet or several thousands of feet into a subterranean formation. The subterranean formation can have different zones. For example, one zone can have a higher permeability compared to another zone. Permeability refers to how easily fluids can flow through a material. For example, if the permeability is high, then fluids will flow more easily and more quickly through the subterranean formation. If the permeability is low, then fluids will flow less easily and more slowly through the subterranean formation. One example of a highly permeable zone in a subterranean formation is a fissure or fracture. The flow rate of a fluid from a subterranean formation into a wellbore or from a wellbore into a formation within one zone may vary. Moreover, the flow rate of a fluid may be greater in one zone compared to another zone. A difference in flow rates within one zone or between zones in a subterranean formation may be undesirable.

During production operations, another common problem is the production of an undesired fluid along with the production of a desired fluid. For example, water production is when water (the undesired fluid) is produced along with oil or gas (the desired fluid). By way of another example, gas may be the undesired fluid while oil is the desired fluid. In yet another example, gas may be the desired fluid while water and oil are the undesired fluid. It is beneficial to produce as little of the undesired fluid as possible.

During secondary recovery operations, an injection well can be used for water flooding. Water flooding is where water is injected into the reservoir to displace oil or gas that was not produced during primary recovery operations. The water from the injection well physically sweeps some of the remaining oil or gas in the reservoir to a production well. Potential problems associated with water flooding techniques can include inefficient recovery due to variable permeability in a subterranean formation and a difference in flow rates of a fluid from the injection well into the subterranean formation.

A flow regulator can be used to help overcome some of these problems. A flow regulator can be used to regulate the flow of a fluid. For a single stream of fluid entering a flow regulator, the regulator can help decrease the flow rate of the fluid exiting the regulator or restrict the volume of fluid exiting the regulator. When two or more separate streams of fluid enter a flow regulator, the regulator can be designed such that the flow rate or total volume of one of the streams can be restricted compared to the other streams when exiting the regulator. By way of example, when a desired homogenous fluid is flowing through the regulator, the regulator can deliver a relatively constant volume of the desired fluid upon exit. However, if an undesired fluid also starts flowing into the regulator, along with the desired fluid, then the regulator can restrict the total volume of the undesired fluid exiting with little change to the volume of the desired fluid exiting the regulator.

A novel device for directing the flow of a fluid uses at least one property of the fluid to direct the flow of the fluid into at least one fluid outlet. According to an embodiment, the at least one property is density or viscosity.

According to an embodiment, a device for directing the flow of a fluid comprises: a fluid chamber; a first outlet; a second outlet; a first outlet fluid passageway, wherein the first outlet fluid passageway is operatively connected to the first outlet; and a second outlet fluid passageway, wherein the second outlet fluid passageway is operatively connected to the second outlet; wherein the fluid rotationally flows about the inside of the chamber, and wherein the fluid flowing through the first outlet fluid passageway conjoins with the fluid flowing through the second outlet fluid passageway at a point downstream of the first and second outlet. As used herein, the term "downstream" means a location that is further away from another location in the direction of fluid flow out of the chamber and through a fluid passageway.

The device for directing the flow of the fluid is designed to be an independent device, i.e., it is designed to automatically direct the fluid to flow into either the first or second outlets based on at least the density or viscosity of the fluid, without any external intervention.

The components of the device for directing the flow of a fluid can be made from a variety of materials. Examples of suitable materials include, but are not limited to: metals, such as steel, aluminum, titanium, and nickel; alloys; plastics; composites, such as fiber reinforced phenolic; ceramics, such as tungsten carbide or alumina; elastomers; and dissolvable materials.

Turning to the Figures. FIG. 1 is a diagram of the device for directing the flow of a fluid 100. The device 100 includes a fluid chamber. As used herein, a "chamber" means a volume surrounded by a structure, where the structure has at least two openings. One of the openings can be a fluid inlet and the other opening can be a fluid outlet. The fluid flows rotationally about the inside of the chamber. According to an embodiment, the chamber is designed such that a fluid is capable of rotationally flowing about the inside of the chamber. For example, the shape of the chamber can be designed such that the fluid rotational flows or is capable of rotationally flowing about the inside of the chamber. The shape of the chamber can be circular, rounded, orbicular, elliptical, cylinoidal, cylindrical, polygonal, frustrum, or conical.

According to an embodiment, depending on at least one of the properties of the fluid, the fluid rotationally flows closer to the outside of the chamber, closer to the center of the chamber, or closer to the outside and closer to the center of the chamber. The at least one of the properties of the fluid can be density or viscosity. For example, the density or viscosity of a homogenous fluid dictates the location within the chamber the fluid will rotationally flow (e.g., closer to the outside of the chamber or closer to the inside of the chamber). By way of another example, the different densities or the different viscosities of the phases of a heterogeneous fluid dictates the location within the chamber each phase of the fluid will rotationally flow (e.g., closer to the outside of the chamber for one of the phases and closer to the center of the chamber for another one of the phases).

During rotational flow, a fluid having a higher density or higher viscosity will be forced farther towards the outside (i.e., the circumference or the perimeter) of the chamber compared to a fluid having a lower density or lower viscosity. This is due in part, to the increased effect that centripetal and reactive centrifugal forces have on the greater mass or viscosity of the higher density/viscosity fluid. As used herein, the term "outside" means the circumference or perimeter of the chamber. According to an embodiment, the phase of the fluid having a higher density or higher viscosity rotationally flows closer to the outside of the chamber and the phase of the fluid having a lower density or lower viscosity rotationally flows closer to the center of the chamber. While the higher density fluid will flow farther towards the outside of the chamber, the lower density fluid will flow closer towards the center of the chamber.

For a homogenous fluid, the location of the fluid flow (i.e., closer towards the outside or closer towards the center of the chamber) will be dictated by the density or viscosity of the fluid, and thus, the fluid will tend to flow in one location rotationally about the inside of the chamber. For a heterogeneous fluid, the flow location of each phase of the fluid will be dictated by the distinct density or viscosity for each phase. For example, a heterogeneous fluid having three phases with the magnitude of densities or viscosities of the phases being in order of: phase 1<phase 2<phase 3, means that phase 3 will flow the closest towards the outside of the chamber, phase 1 will flow the closest towards the center of the chamber, and phase 2 will flow somewhere in between phase 3 and phase 1. Of course, the exact location of the different phases will be dictated by the actual density or viscosity of each phase. In the preceding example, if the density of phase 2 is closer in value to the density of phase 1 compared to phase 3, then phase 2 will flow closer towards phase 1 about the inside of the chamber and vice versa. The preceding statement is also true for the different viscosities of each phase.

Figure 3:
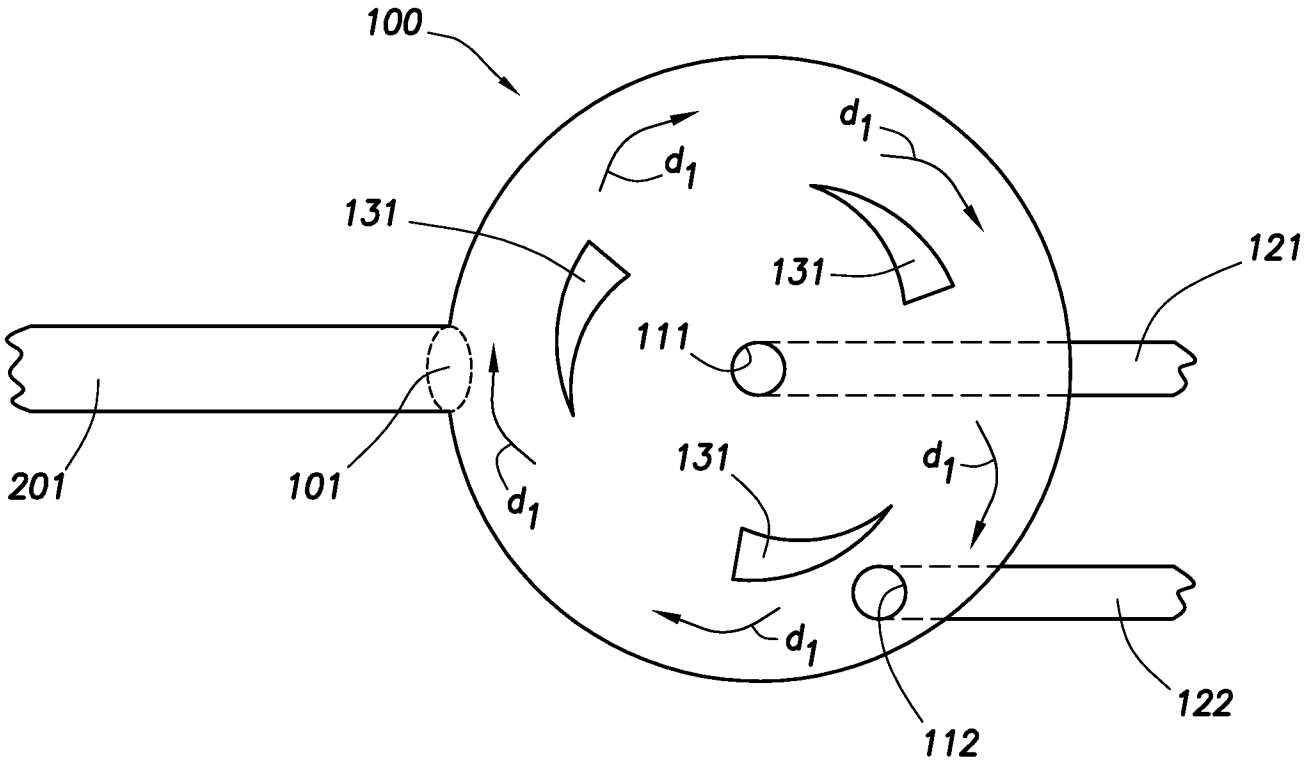
FIG. 3 is a diagram of the device comprising fluid directors for inducing rotational flow of a fluid within the chamber.

The device 100 can further include at least one inlet 101. The chamber can be operatively connected to a first fluid passageway 201 via the first inlet 101. In this manner, a fluid can enter the chamber via the first fluid passageway 201 through the first inlet 101. The fluid can be a homogenous fluid or a heterogeneous fluid. The chamber can be connected to the first fluid passageway 201 in a variety of ways. For example, and as depicted in some of the figures, the first fluid passageway 201 is connected to the chamber such that the fluid can enter the chamber in a tangential direction relative to a radius of the chamber. The first fluid passageway 201 can also be connected to the chamber such that the fluid can enter the chamber in a radial direction or an axial direction relative to a radius of the chamber. For example, FIG. 3 depicts the first fluid passageway 201 connected to the chamber such that the fluid enters the chamber in a radial direction relative to a radius of the chamber. Preferably, the first fluid passageway 201 is connected to the chamber in a manner such that the fluid, upon entering the chamber, is induced to flow in a rotational direction about the inside of the chamber.

According to another embodiment, both the manner in which the first fluid passageway 201 is connected to the chamber and the design of the chamber work in tandem to induce rotational flow of the fluid about the inside of the chamber. By way of example, if the first fluid passageway 201 is connected to the chamber such that the fluid enters the chamber tangentially, then the only design consideration may be the shape of the chamber. By way of another example, if the first fluid passageway 201 is connected to the chamber such that the fluid enters the chamber radially or axially, then the chamber may need to include design elements in addition to the shape of the chamber. An example of a design element in addition to shape includes, but is not limited to at least one fluid director 131, shown in FIG. 3. According to an embodiment, the fluid director 131 induces rotational flow of the fluid about the inside of the chamber. For example, the fluid director 131 can have a shape such that the fluid, upon entering the chamber, is induced to flow rotationally about the inside of the chamber. At least one edge of the fluid director 131 can induce rotational flow in the direction of $d_1$ (such as by being curved). Additionally, another edge can inhibit flow of the fluid in a radial direction or in a direction other than $d_1$ (such as by being relatively straight-sided).

The first fluid passageway 201 (and any other passageways) can be tubular, rectangular, pyramidal, or curlicue in shape. Although illustrated as a single passageway, the first fluid passageway 201 (and any other passageway) could feature multiple passageways connected in parallel.

Figure 2A:
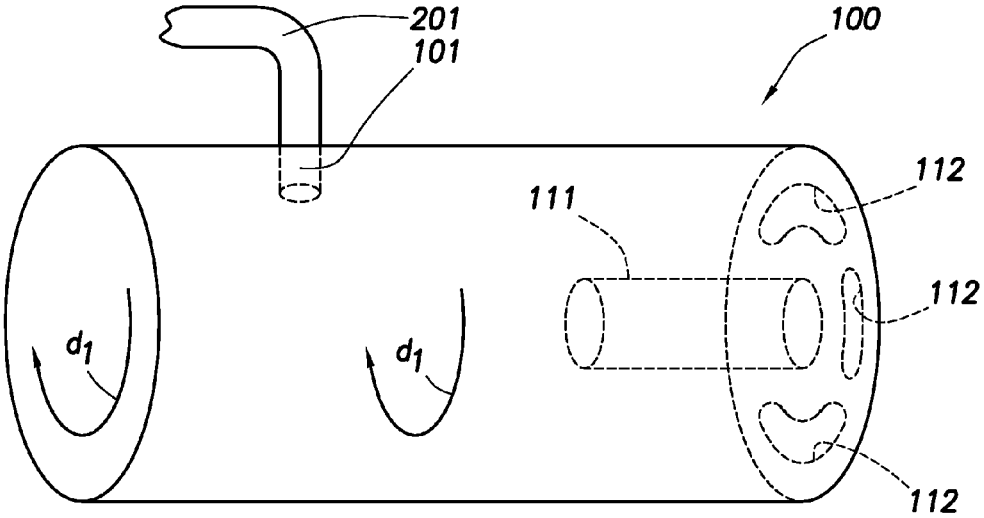
FIGS. 2A and 2B illustrates rotational flow of a fluid within a chamber of the device in two different directions.
Figure 2B:
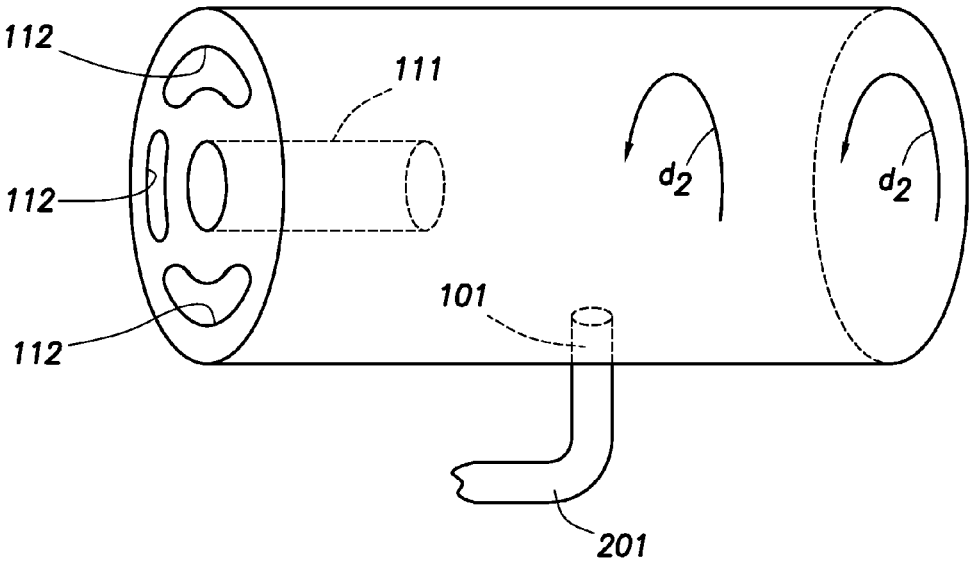

The device includes at least one first outlet 111 and at least one second outlet 112. The device can include more than one of each outlet. As depicted in FIGS. 2A and 2B, the device includes three second outlets 112. Any discussion of a particular component of the device 100 (e.g., a second outlet 112) is meant to include the singular form of the component and also the plural form of the component, without the need to continually refer to the component in both the singular and plural form throughout. For example, if a discussion involves "the second outlet 112," it is to be understood that the discussion pertains to one second outlet (singular) and two or more second outlets (plural). The first or second outlets 111/112 can be positioned at different distances from the center of the chamber 100. For example, if there are two or more second outlets 112, then each of the second outlets 112 can be located at a different distance from the center of the chamber 100.

According to an embodiment, the first outlet 111 is positioned within the chamber at a location in the center or closer to the center of the chamber. If a fluid is rotationally flowing closer to the center of the chamber, then at least some of this fluid can exit the chamber via the first outlet 111. Preferably, the majority of a fluid flowing closer to the center will exit the chamber via the first outlet 111. According to another embodiment, the second outlet 112 is positioned within the chamber at a location closer to the outside of the chamber. If a fluid is rotationally flowing closer to the outside of the chamber, then at least some of this fluid can exit the chamber via the second outlet 112. Preferably, the majority of a fluid flowing closer to the circumference will exit the chamber via the second outlet 112.

The outlets 111/112 can be oriented within the chamber in relation to the direction of fluid rotation. As can be seen in FIG. 2A, the first fluid passageway 201 is positioned relative to the chamber such that a fluid can enter the chamber and rotationally flow about the inside of the chamber in the direction of $d_1$. When the fluid is rotationally flowing in the direction of $d_1$, then the outlets 111/112 should be positioned adjacent to the direction of fluid exit (shown on the right-hand side of the chamber). As can be seen in FIG. 2B, the first fluid passageway 201 is positioned relative to the chamber such that a fluid can enter the chamber and rotationally flow about the inside of the chamber in the direction of $d_2$. When the fluid is rotationally flowing in the direction of $d_2$, then the outlets 111/112 should be positioned adjacent to the direction of fluid exit (shown on the left-hand side of the chamber).

One of the advantages to the device for directing the flow of a fluid 100 is that the device does not need to be oriented with gravity in order for the chamber to direct the fluid into one or more of the fluid outlets 111/112 based on a property of the fluid. Because the device 100 does not need to be oriented with gravity, the device 100 is simpler in design and easier to install in a wellbore compared to other fluid directors that do need to be oriented with gravity. For example, the device 100 does not need to contain parts, such as floats or weights, for determining an orientation with gravity. Moreover, the lack of gravity orientation allows for more versatility in installation and positioning of the device 100 within a wellbore.

It should be understood that the chamber is designed to direct the fluid into a rotational flow path about the inside of the chamber at one or more locations within the chamber based on at least one property of a homogenous fluid or a difference in the properties of each phase of a heterogeneous fluid. For a heterogeneous fluid, each phase may have a different density or viscosity compared to the other phases. For a heterogeneous fluid, the device is most preferably for use with a fluid wherein each of the phases have a different density compared to the other phases, but wherein each of the phases have a similar viscosity compared to the other phases. Some examples of heterogeneous fluids that have different densities but similar viscosities include, but are not limited to: a water and gas mixture; an oil and water mixture; a natural gas and carbon dioxide mixture; and a gas and gas condensate mixture.

The chamber can further include at least one first outlet fluid passageway 121 and at least one second outlet fluid passageway 122. Preferably, the first outlet fluid passageway 121 is connected to the first outlet 111. Preferably, the second outlet fluid passageway 122 is connected to the second outlet 112. If there is more than one outlet (e.g., two or more second outlets), then each outlet can be connected to two or more passageways (e.g., two or more second outlet fluid passageways) or all of the outlets can be connected to only one passageway. The fluid velocity or flow rate will vary in each of the passageways 121/122 depending, in part, on the at least one of the properties of the fluid in each of the passageways. Assuming the passageways are identical (e.g., having the same dimensions and angles of any bends in the passageway), the fluid flowing through the first outlet fluid passageway 121 will have a particular flow rate and the fluid flowing through the second outlet fluid passageway 122 will have a different flow rate based on the difference in properties of the fluids. For example, if the fluid flowing through the second outlet fluid passageway 122 has a density that is greater than the fluid flowing through the first outlet fluid passageway 121, then the flow rate of the fluid through the second outlet fluid passageway 122 will be greater than the flow rate of the fluid flowing through the first outlet fluid passageway 121. Of course, the diameter of any of the passageways or the angle of any bends in the passageways can be adjusted to help control the flow rate of a fluid through that particular passageway.

Figure 4:
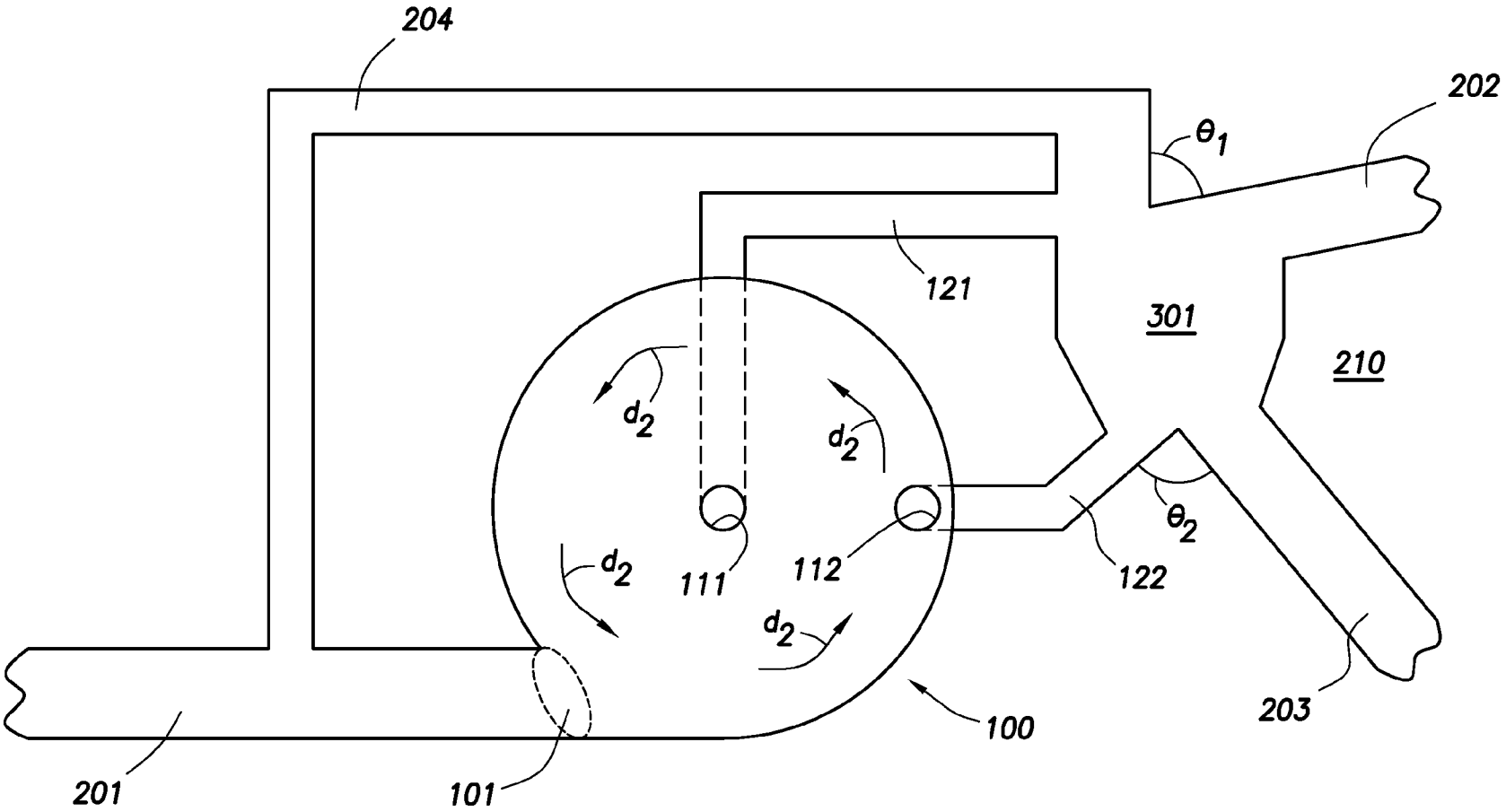
FIG. 4 is a diagram of a system comprising one device for directing the flow of a fluid and a bypass passageway.

According to an embodiment, the fluid flowing through the first and second outlet fluid passageways 121/122 conjoins at a junction 301. The junction 301 can be a vortex triode or a switch. The first and second outlet fluid passageways 121/122 can terminate at the junction. The first and second outlet fluid passageways 121/122 can also be operatively connected to the junction. As can be seen in FIGS. 1 and 3, the first outlet fluid passageway 121 and the second outlet fluid passageway 122 terminate at the junction 301. According to another embodiment, additional fluid passageways can also terminate at the junction 301. For example, FIG. 4 illustrates a fourth fluid passageway 204 terminating at the junction 301 in addition to the first outlet fluid passageway 121 and the second outlet fluid passageway 122. According to this embodiment, the fourth fluid passageway 204 can bypass the device 100 such that any fluid flowing into the fourth fluid passageway 204 directly enters the junction 301. There may be several reasons why a bypass passageway is beneficial. One example of such a reason is when the fluid is relatively viscous. For relatively viscous fluids, the bypass passageway 204 can allow for a decreased pressure drop in the system compared to when all of the fluid enters the chamber.

The flow rate of the fluid entering the junction 301 will depend on the flow rate of the fluid in each passageway. For example, the higher the flow rate of a fluid flowing through a particular passageway, the higher the flow rate that fluid will enter the junction 301. Thus, for similar passageways (e.g., dimensions and angle of bends), the fluid flowing through the second outlet fluid passageway 122 will enter the junction 301 at a greater flow rate compared to the fluid flowing through the first outlet fluid passageway 121.

According to an embodiment, a device for directing the flow of a fluid comprises: a sensor; a first outlet connected to the sensor; a second outlet connected to the sensor; a first outlet fluid passageway, wherein the first outlet fluid passageway is operatively connected to the first outlet; and a second outlet fluid passageway, wherein the second outlet fluid passageway is operatively connected to the second outlet; wherein as the total number of phases of the fluid increases, the sensor directs at least a first phase of the fluid into the first outlet fluid passageway and directs at least a second phase of the fluid into the second outlet fluid passageway, and wherein the fluid flowing through the first outlet fluid passageway conjoins with the fluid flowing through the second outlet fluid passageway at a point downstream of the first and second outlet. The sensor can be a centrifugal chamber.

The device for directing the flow of a fluid 100 can be used in any system. An example of a system is a flow regulator 25, illustrated in FIG. 7. The system can comprise: the device for directing the flow of a fluid 100; a first fluid passageway 201; a second fluid passageway 202; and a third fluid passageway 203. The system can also include an exit assembly (not shown). The exit assembly can be a vortex triode. The system can also include a fourth fluid passageway 204.

Figure 5:
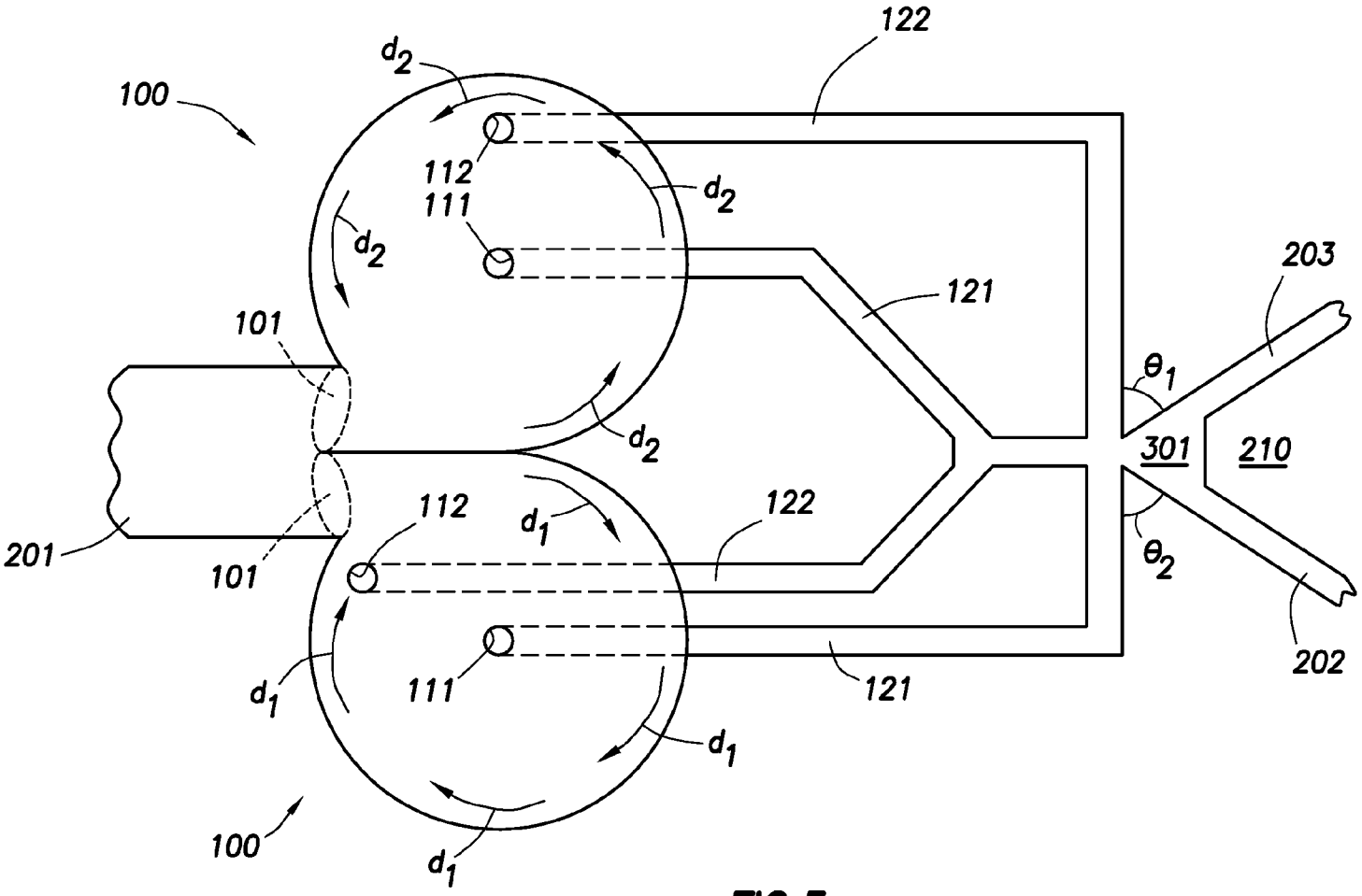
FIG. 5 is a diagram of a system comprising two devices for directing the flow of a fluid.
Figure 6:
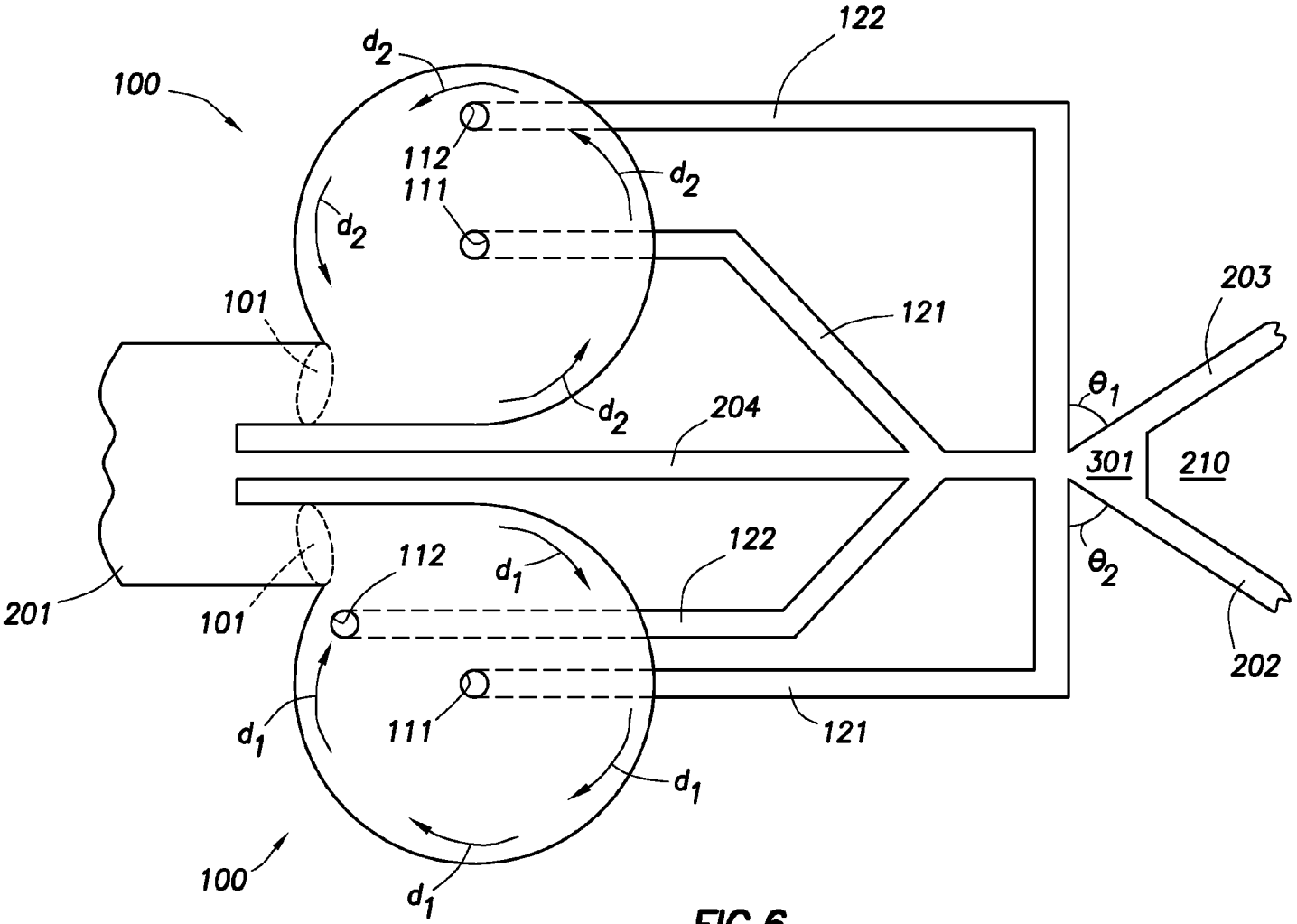
FIG. 6 is a diagram of a system comprising two devices for directing the flow of a fluid and a bypass passageway.

FIGS. 1, 3, and 4 show the system comprising one device 100. FIGS. 5 and 6 depict the system comprising two devices 100. The system can also include more than two devices 100. As can be seen in FIG. 5, the system includes two devices 100, wherein each device is connected to the first fluid passageway 201 without a bypass passageway. As can be seen in FIG. 6, the system includes two devices 100, wherein each device and a bypass passageway 204 are connected to the first fluid passageway 201. The fluid passageways can be connected in a variety of ways. Each of the devices 100 can be connected to the first fluid passageway 201 in the same manner or a different manner. For example, a first device 100 can be connected to the first fluid passageway 201 such that the fluid enters the chamber tangentially while a second device 100 can be connected such that the fluid enters the chamber radially or axially with respect to an axis of the chamber. According to an embodiment, the first outlet fluid passageway 121 of the second device 100 and the second outlet fluid passageway 122 of the first device terminate at the junction 301. According to another embodiment, the second outlet fluid passageway 122 of the second device 100 and the first outlet fluid passageway 121 of the first device join together at a section of passageway that then terminates at the junction 301. According to yet another embodiment, the second outlet fluid passageway 122 of the second device 100, the first outlet fluid passageway 121 of the first device, and the bypass passageway 204 join together at a section of passageway that then terminates at the junction 301.

Any of the passageways 121, 122, or 204 can be connected directly to the exit assembly (not shown). Any of the passageways 121, 122, or 204 can be operatively connected to the exit assembly via the junction 301 or other intermediary passageways. According to an embodiment, the junction 301 can be connected to the second fluid passageway 202 and the third fluid passageway 203. According to this embodiment, the second fluid passageway 202 and the third fluid passageway 203 are connected to the exit assembly. According to another embodiment, the second fluid passageway 202 and the third fluid passageway 203 can branch at a branching point 210. The passageways 202/203 can branch at a variety of angles $\theta_1$ and $\theta_2$. Preferably, the passageways 202/203 are connected to the junction 301 such that depending on the flow rate of the fluid entering the junction 301 via the first outlet fluid passageway 121 and/or the second outlet fluid passageway 122, the fluid is directed into one or both of the passageways 202/203. For example, if one fluid is flowing through the second outlet fluid passageway 122 at a higher velocity compared to another fluid that is flowing through the first outlet fluid passageway 121, then at least some of the fluid entering the junction 301 via the second outlet fluid passageway 122 can be directed into the second fluid passageway 202. Conversely, the fluid entering the junction 301 via the first outlet fluid passageway 121 can be directed into the third fluid passageway 203. Most preferably, in the above example, a majority of the fluid entering the junction 301 via the second outlet fluid passageway 122 is directed into the second fluid passageway 202, while a majority of the fluid entering the junction 301 via the first outlet fluid passageway 121 is directed into the third fluid passageway 203. As used herein, the term "majority" means greater than 50%.

According to an embodiment, the passageways 202/203 are connected to an exit assembly. According to this embodiment, the exit assembly is preferably capable of regulating the flow rate of the fluid exiting the assembly. By way of example, the exit assembly may be designed such that a constant flow rate of fluid will exit the assembly even though the flow rate of the fluid entering the assembly via the passageways 202/203 may be different.

A desired flow rate of a fluid exiting the exit assembly can be predetermined. The predetermined flow rate can be selected based on the type of fluid entering the device. The predetermined flow rate can differ based on the type of the fluid. The predetermined flow rate can also be selected based on a property of the fluid entering the device 100. For example, depending on the specific application, the desired flow rate of a gas-based fluid may be predetermined to be 150 barrels per day (BPD); whereas, the desired flow rate of an oil-based fluid may be predetermined to be 300 BPD. Of course, one device 100 can be designed with a predetermined flow rate of 150 BPD and another device 100 can be designed with a predetermined flow rate of 300 BPD. Moreover, if more than one device 100 is used in a system, then each of the devices 100 can be designed with a different predetermined flow rate.

The system can be designed to cooperatively interact with the device 100 to regulate a fluid exiting the system. The following examples are not the only examples that could be used to illustrate the cooperative interaction. When a homogonous fluid having a low density enters the chamber, the fluid will tend to flow rotationally about the inside of the chamber closer to the center of the chamber. At least some of the fluid and more preferably, the majority of the fluid, will exit the chamber via the first outlet 111 and flow into the first outlet fluid passageway 121 towards the junction 301. Because of the lower density of the fluid, the flow rate of the fluid entering the junction 301 can be relatively low, thus causing the fluid to increasingly flow into the third fluid passageway 203. As such, the flow regulator can have little effect on restricting the fluid exiting the regulator. As the density of the homogenous fluid increases, the fluid entering the chamber will increasingly flow rotationally about the inside of the chamber at a location closer to the outside of the chamber. The fluid will then increasingly exit the chamber via the second outlet 112 and flow into the second outlet fluid passageway 122 towards the junction 301. Because of the increased density, the flow rate of the fluid entering the junction 301 will be greater than any fluid entering via the first outlet fluid passageway 121. As a result, the fluid will increasingly flow into the second fluid passageway 202.

The device can be used to detect a phase change of a fluid entering the system. For example, if oil is being produced, the device can be used to detect the onset of water production along with the oil and direct each phase of the fluid (e.g., the water and the oil) into two or more fluid passageways. In this example, if the fluid entering the system becomes a heterogeneous fluid, then the fluid will enter the chamber and rotationally flow about the inside of the chamber. Each phase of the fluid will then be directed to a particular location within the chamber based on at least one property of each of the phases. For example, the higher-density phase will tend to exit the chamber via the second outlet 112 and flow into the second outlet fluid passageway 122, while the lower-density phase will tend to exit the chamber via the first outlet 111 and flow into the first outlet fluid passageway 121. As mentioned above, the flow rate of the fluid in the second outlet fluid passageway 122 will tend to be greater than the flow rate of the fluid in the first outlet fluid passageway 121. As a result, more of the fluid will enter the second fluid passageway 202 and less of the fluid will enter the third fluid passageway 203. The exit assembly can then function to restrict the total volume of the water exiting the system, but not restrict the total volume of oil exiting the system based on the amount of fluid entering the exit assembly via the passageways 202/203.

According to an embodiment, the system is a flow regulator 25. According to another embodiment, the flow regulator is used in a subterranean formation. A flow regulator 25 used in a subterranean formation is illustrated in FIG. 7.

Figure 7:
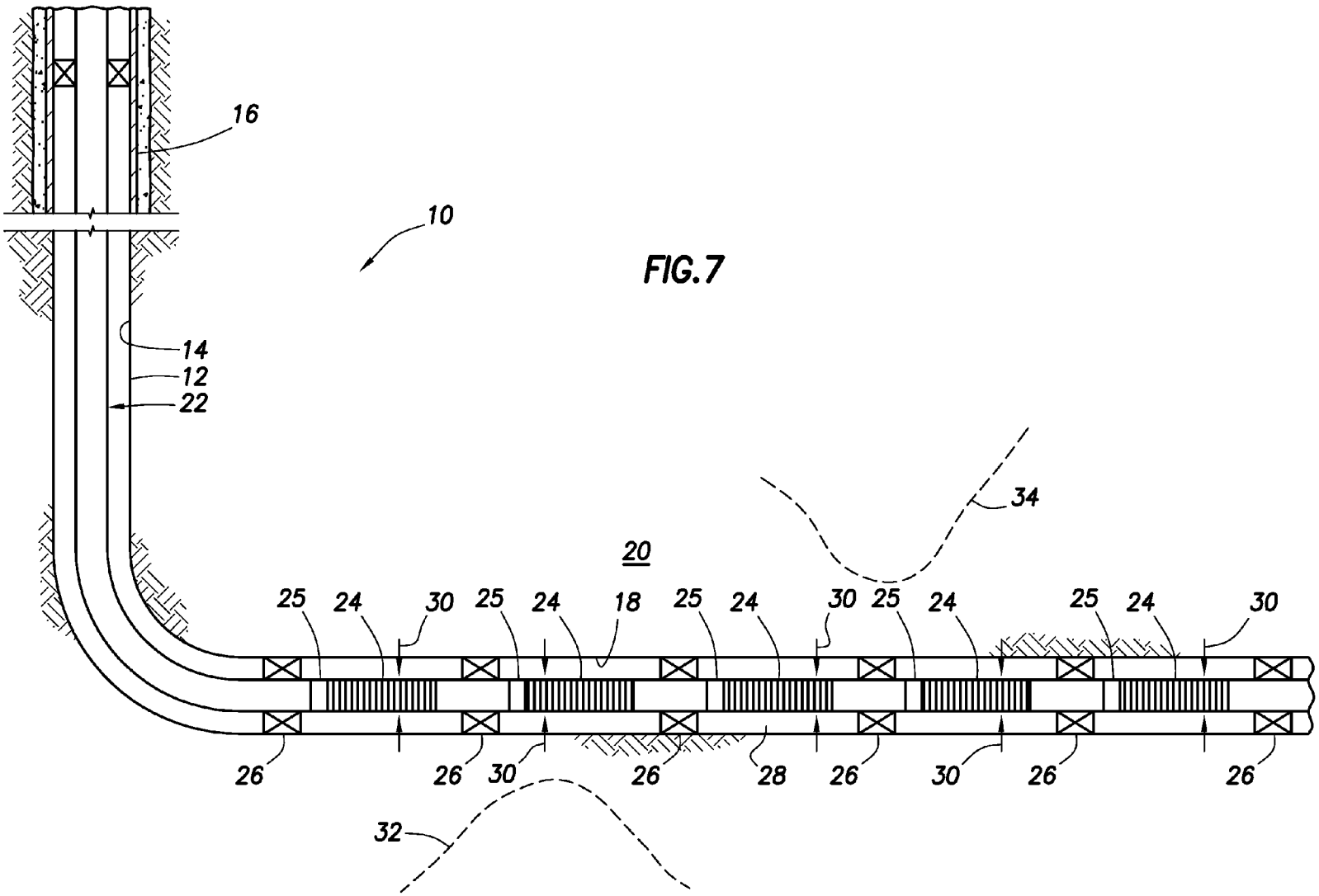
FIG. 7 is a well system containing at least one flow regulator comprising the device for directing the flow of a fluid.

FIG. 7 is a well system 10 which can encompass certain embodiments. As depicted in FIG. 7, a wellbore 12 has a generally vertical uncased section 14 extending downwardly from a casing 16, as well as a generally horizontal uncased section 18 extending through a subterranean formation 20. The subterranean formation 20 can be a portion of a reservoir or adjacent to a reservoir.

A tubing string 22 (such as a production tubing string) is installed in the wellbore 12. Interconnected in the tubing string 22 are multiple well screens 24, flow regulators 25, and packers 26.

The packers 26 seal off an annulus 28 formed radially between the tubing string 22 and the wellbore section 18. In this manner, a fluid 30 may be produced from multiple zones of the formation 20 via isolated portions of the annulus 28 between adjacent pairs of the packers 26.

Positioned between each adjacent pair of the packers 26, a well screen 24 and a flow regulator 25 are interconnected in the tubing string 22. The well screen 24 filters the fluid 30 flowing into the tubing string 22 from the annulus 28. The flow regulator 25 regulates the flow rate of the fluid 30 into the tubing string 22, based on certain characteristics of the fluid, e.g., the density of the fluid. In another embodiment, the well system 10 is an injection well and the flow regulator 25 regulates the flow rate of fluid 30 out of the tubing string 22 and into the formation 20.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, cement may be used instead of packers 26 to isolate different zones. Cement may also be used in addition to packers 26.

By way of another example, the wellbore 12 can include only a generally vertical wellbore section 14 or can include only a generally horizontal wellbore section 18. The fluid 30 can be produced from the formation 20, the fluid could also be injected into the formation, and the fluid could be both injected into and produced from the formation.

The well system does not need to include a packer 26. Also, it is not necessary for only one well screen 24 and only one flow regulator 25 to be positioned between each adjacent pair of the packers 26. It is also not necessary for a single flow regulator 25 to be used in conjunction with a single well screen 24. Any number, arrangement and/or combination of these components may be used. Moreover, it is not necessary for any flow regulator 25 to be used in conjunction with a well screen 24. For example, in injection wells, the injected fluid could be flowed through a flow regulator 25, without also flowing through a well screen 24. There can be multiple flow regulators 25 connected in fluid parallel or series.

It is not necessary for the well screens 24, flow regulator 25, packers 26 or any other components of the tubing string 22 to be positioned in uncased sections 14, 18 of the wellbore 12. Any section of the wellbore 12 may be cased or uncased, and any portion of the tubing string 22 may be positioned in an uncased or cased section of the wellbore, in keeping with the principles of this disclosure.

It will be appreciated by those skilled in the art that it would be beneficial to be able to regulate the flow rate of the fluid 30 entering into the tubing string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

The flow regulator 25 can be positioned in the tubing string 22 in a manner such that the fluid 30 enters the first fluid passageway 201 and travels into the chamber via the fluid inlet 101. For example, in a production well, the regulator 25 may be positioned such that the first fluid passageway 201 is functionally oriented towards the formation 20. Therefore, as the fluid 30 flows from the formation 20 into the tubing string 22, the fluid 30 will enter the first fluid passageway 201. By way of another example, in an injection well, the regulator 25 may be positioned such that the first fluid passageway 201 is functionally oriented towards the tubing string 22. Therefore, as the fluid 30 flows from the tubing string 22 into the formation 20, the fluid 30 will enter the first fluid passageway 201.

An advantage for when the device for directing the flow of a fluid 100 is used in a flow regulator 25 in a subterranean formation 20, is that it can help regulate the flow rate of a fluid within a particular zone and also regulate the flow rates of a fluid between two or more zones. Another advantage is that the device 100 can help solve the problem of production of a heterogeneous fluid. For example, if oil is the desired fluid to be produced, the device 100 can be designed such that if water enters the flow regulator 25 along with the oil, then the device 100 can direct the oil to increasingly flow into the second fluid passageway 202 based on the higher density of the oil compared to water. The versatility of the device 100 allows for specific problems in a formation to be addressed.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A device for directing the flow of a fluid comprises:

a fluid chamber;

a first outlet;

a second outlet;

a first outlet fluid passageway, wherein the first outlet fluid passageway is operatively connected to the first outlet; and a second outlet fluid passageway, wherein the second outlet fluid passageway is operatively connected to the second outlet;

wherein the fluid rotationally flows about the inside of the chamber, wherein the fluid flowing through the first outlet fluid passageway conjoins with the fluid flowing through the second outlet fluid passageway at a point downstream of the first and second outlet, wherein the fluid flowing through the first and second outlet fluid passageways conjoins at a junction, and wherein the junction is a vortex triode or a switch.

2. The device according to claim 1, wherein the shape of the chamber is selected such that the fluid rotationally flows about the inside of the chamber.

3. The device according to claim 1, wherein depending on at least one of the properties of the fluid, the fluid rotationally flows closer to the outside of the chamber, closer to the center of the chamber, or closer to the outside and closer to the center of the chamber.

4. The device according to claim 3, wherein the at least one of the properties of the fluid is density or viscosity.

5. The device according to claim 4, wherein as the density or the viscosity of the fluid increases, the fluid increasingly flows closer to the outside of the chamber and wherein as the density or the viscosity of the fluid decreases, the fluid increasingly flows closer to the center of the chamber.

6. The device according to claim 4, wherein the fluid is a heterogeneous fluid having at least two phases.

7. The device according to claim 6, wherein the phase of the fluid having a higher density or higher viscosity rotationally flows closer to the outside of the chamber and the phase of the fluid having a lower density or lower viscosity rotationally flows closer to the center of the chamber.

8. The device according to claim 1, wherein the chamber further comprises an inlet.

9. The device according to claim 8, further comprising a first fluid passageway, wherein the first fluid passageway is operatively connected to the chamber via the inlet.

10. The device according to claim 9, wherein the first fluid passageway is connected to the chamber such that the fluid can enter the chamber in a tangential direction relative to a radius of the chamber.

11. The device according to claim 9, wherein the first fluid passageway is connected to the chamber such that the fluid can enter the chamber in a radial direction or an axial direction relative to a radius of the chamber.

12. The device according to claim 11, further comprising at least one fluid director.

13. The device according to claim 12, wherein the at least one fluid director induces rotational flow of the fluid about the inside of the chamber.

14. The device according to claim 1, wherein at least some of the fluid rotationally flowing closer to the outside of the chamber exits the chamber via the second outlet and wherein at least some of the fluid rotationally flowing closer to the center of the chamber exits the chamber via the first outlet.

15. The device according to claim 1, wherein the majority of the fluid rotationally flowing closer to the outside of the chamber exits the chamber via the second outlet and wherein the majority of the fluid rotationally flowing closer to the center of the chamber exits the chamber via the first outlet.

16. The device according to claim 1, wherein the first and second outlet fluid passageways terminate at the junction.

* * * * *